US009803916B2

(12) United States Patent
Park et al.

(10) Patent No.: US 9,803,916 B2
(45) Date of Patent: Oct. 31, 2017

(54) REFRIGERATOR

(71) Applicant: LG ELECTRONICS INC., Seoul (KR)

(72) Inventors: Junsoo Park, Seoul (KR); Jiyeong Ku, Seoul (KR); Jiyoon Lee, Seoul (KR); Jiyoung Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/983,752

(22) Filed: Dec. 30, 2015

(65) Prior Publication Data

US 2016/0187054 A1 Jun. 30, 2016

(30) Foreign Application Priority Data

Dec. 31, 2014 (KR) ..... 10-2014-0195847

(51) Int. Cl.
*A47B 96/04* (2006.01)
*F25D 25/02* (2006.01)
*F25D 23/06* (2006.01)

(52) U.S. Cl.
CPC ..... *F25D 25/027* (2013.01); *F25D 23/067* (2013.01); *F25D 25/02* (2013.01); *F25D 25/024* (2013.01); *F25D 2325/021* (2013.01)

(58) Field of Classification Search
CPC ..... F25D 25/027; F25D 25/024; F25D 25/02; F25D 23/062; F25D 2325/021; A47B 46/005; A47B 57/06; A47B 96/025; A47B 51/00
USPC .... 312/408, 295, 310, 311, 319.3, 322, 323, 312/325
See application file for complete search history.

(56) References Cited

U.S. PATENT DOCUMENTS 2,069,706 A * 2/1937 Gerwig ..... F24C 15/162 126/340
2,173,108 A * 9/1939 Hallock ..... F25D 25/024 211/134
2,926,507 A * 3/1960 Ingolia ..... F25D 17/062 312/23
3,316,044 A * 4/1967 Carbary ..... A47B 57/06 108/106
8,297,726 B2 * 10/2012 Ramm ..... A47B 51/00 312/408

(Continued)

FOREIGN PATENT DOCUMENTS

DE 102010039622 2/2012
EP 2805122 11/2014

(Continued)

OTHER PUBLICATIONS

Extended European Search Report issued in European Application No. 15203154.8 on May 9, 2016, 7 pages.

*Primary Examiner* — Daniel J Troy
*Assistant Examiner* — Timothy M Ayres
(74) *Attorney, Agent, or Firm* — Fish & Richardson P.C.

(57) ABSTRACT

A refrigerator includes a rear shelf that is located in a case that defines a storage compartment with an open front. The refrigerator further includes a front shelf that is located closer to the open front of the storage compartment than the rear shelf. The refrigerator further includes a guard that is rotatably connected to the front shelf. The refrigerator further includes a front shelf lifting device that is configured to rotate the front shelf down about an axis at the rear shelf based on the guard moving up.

18 Claims, 10 Drawing Sheets

(56) References Cited

U.S. PATENT DOCUMENTS

| | | | | |
|---|---|---|---|---|
| 8,549,872 | B2 * | 10/2013 | Kwon | F25D 23/12 312/271 |
| D695,796 | S * | 12/2013 | Lee | D15/89 |
| 8,740,322 | B2 * | 6/2014 | Moon | F25D 23/067 312/408 |
| 8,936,333 | B2 * | 1/2015 | Turner | F24C 15/16 126/337 A |
| 9,127,877 | B2 * | 9/2015 | Lee | F25D 25/024 |
| 9,170,043 | B2 * | 10/2015 | Choo | F25D 23/00 |
| D745,581 | S * | 12/2015 | Jeon | D15/89 |
| 2016/0031354 | A1 * | 2/2016 | Miles | B60P 1/4414 211/1.51 |

FOREIGN PATENT DOCUMENTS

| | | |
|---|---|---|
| JP | H08-303914 | 11/1996 |
| WO | 2013/107711 | 7/2013 |
| WO | 2014/138797 | 9/2014 |

* cited by examiner

REFRIGERATOR

CROSS-REFERENCE TO RELATED APPLICATION

This application claims the priority benefit of Korean Patent Application No. 10-2014-0195847, filed on Dec. 31, 2014 in the Korean Intellectual Property Office, the disclosure of which is incorporated herein by reference.

FIELD

The present disclosure relates to a refrigerator.

BACKGROUND

In general, a refrigerator is an appliance that cools a storage compartment, such as a refrigerating compartment or a freezing compartment, using a refrigeration cycle circuit, which includes a compressor, a condenser, an expansion device, and an evaporator, or a thermoelectric module, and stores goods, such as food, in the storage compartment, which is cooled as described above.

The refrigerator includes an inner case, which defines the storage compartment therein, and a door, which is configured to open and close to the storage compartment. A storage unit, such as a shelf, on which food is stored, or a drawer, in which food is stored, is disposed in the storage compartment. The storage unit may be configured to have a multiple layer structure.

The refrigerator may further include a sliding guide configured to guide the sliding movement of the shelf in forward and rearward directions. The sliding guide may be mounted in the inner case.

SUMMARY

According to an innovative aspect of the subject matter described in this application, a refrigerator includes a rear shelf that is located in a case that defines a storage compartment with an open front; a front shelf that is located closer to the open front of the storage compartment than the rear shelf; a guard that is rotatably connected to the front shelf; and a front shelf lifting device that is configured to rotate the front shelf down about an axis at the rear shelf based on the guard moving up.

The refrigerator may include one or more of the following optional features. The front shelf lifting device is configured to maintain an orientation of the front shelf during rotation. The front shelf lifting device includes a connection bar that is configured to connect the front shelf and the rear shelf; and an interlocking mechanism that is configured to rotate the connection bar in a first direction and that is configured to rotate the guard in a second direction that is opposite the first direction. The interlocking mechanism includes a first gear that is located at the connection bar; and a second gear that is located at the guard that is configured to rotate the guard in the second direction and the connection bar in the first direction by engaging the first gear. The interlocking mechanism is configured to prevent rotation of the connection bar in the first direction based on the guard rotating in the second direction, and prevent rotation of the guard in the second direction based on the connection bar rotating in the first direction.

The guard includes a side guard that is located at a lateral surface of the front shelf; and a front guard that is located at a front surface of the front shelf. The side guard includes a left guard part that is located at a left lateral surface of the front shelf; and a right guard part that is located at a right lateral surface of the front shelf. The side guard is hinged to the front shelf. The second gear is located at the side guard. An end of the connection bar that faces a lateral surface of the front shelf is hinged to the front shelf. The first gear is located at an end of the connection bar that faces a lateral surface of the front shelf and is adjacent to the second gear. A diameter of the second gear is greater than a diameter of the first gear. The front shelf includes a guide protrusion member that protrudes from the front shelf. The inner case includes a protrusion member guide rail that is configured to guide a sliding movement of the guide protrusion member. The refrigerator further includes an elastic member that is located at a lower end of the protrusion member guide rail and that is connected to the guide protrusion member.

The refrigerator further includes a protruding part that is located on at least one of an upper part of a front end of the rear shelf or an upper part of a rear end of the front shelf and that is configured to protrude upward. The rear shelf includes a connection bar guide rail that is configured to guide a sliding movement of the connection bar towards a front of the refrigerator and towards a rear of the refrigerator. The connection bar guide rail is configured to maintain the front shelf and the rear shelf in a same plane during the sliding movement of the connection bar towards the front of the refrigerator and towards the rear of the refrigerator. A rear shelf guide is located in the case and is configured to guide a sliding movement of the rear shelf towards a front of the refrigerator and towards a rear of the refrigerator. The refrigerator further includes a non-slip mat that is located on a top surface of the front shelf. The front shelf lifting device is configured to move a rear portion of front shelf below a front portion of the rear shelf.

It is an object of the subject matter described in this application to provide a refrigerator that is capable of improving the usability of a shelf disposed at the upper side of a storage compartment, which it is difficult for a user to see or to access.

It is another object of the subject matter described in this application to provide a refrigerator that is capable of enabling a user to place goods to be stored on a shelf and to remove the stored goods from the shelf and of maximally preventing the stored goods from tipping over on the shelf or slipping and falling off the shelf.

It is another object of the subject matter described in this application to provide a refrigerator that is capable of enabling a user to easily check food placed on a shelf and preventing damage to the shelf due to falling off the shelf.

It is another object of the subject matter described in this application to provide a refrigerator that is capable of reducing impact when a shelf is moved and is then stopped, thereby reducing noise and improving durability, and preventing damage to food due to falling of the food.

It is another object of the subject matter described in this application to provide a refrigerator that is capable of enabling a user to adjust the forward movement of a shelf as needed, thereby improving user convenience.

Figure 1:
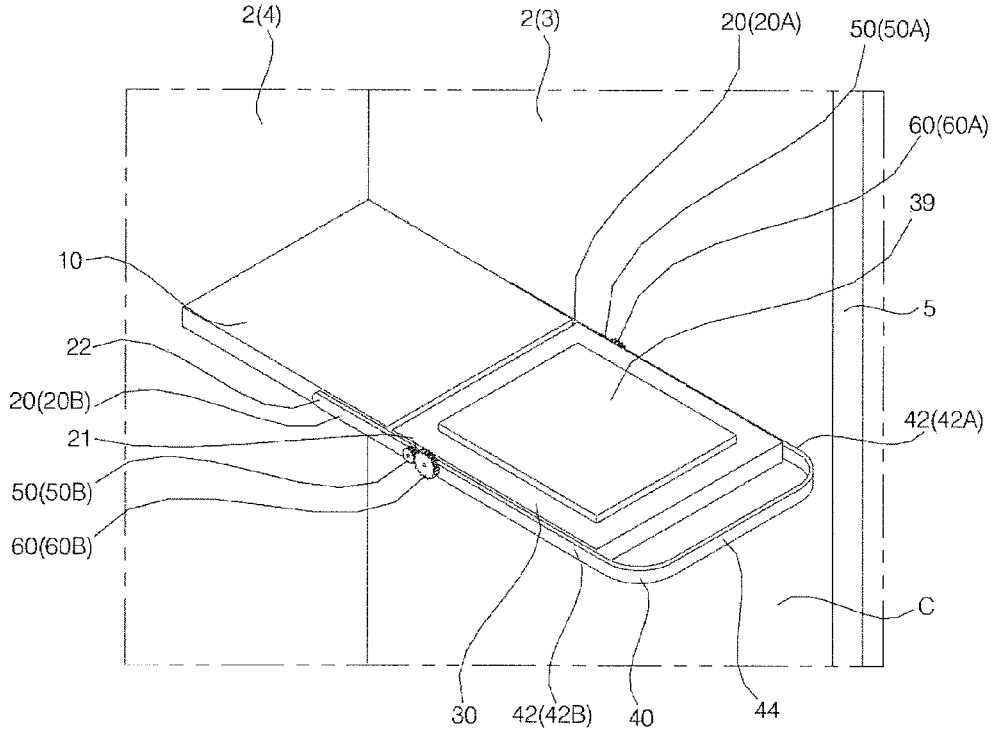
FIG. 1 is a perspective view of an example front shelf and an example guard of a refrigerator.

Throughout the drawings, "F" designates a forward direction and "R" designates a back direction.

DETAILED DESCRIPTION

FIGS. 1-7 illustrate example front shelves and example guards of a refrigerator The refrigerator includes a rear shelf 10 disposed in an inner case 2, which defines a storage compartment therein, a front shelf 30, and a guard 40 rotatably connected to the front shelf 30. In addition, the refrigerator further includes a front shelf lifting device configured to move the front shelf 30 downward while rotating the front shelf 30 using the rear shelf 10 as the center of rotation when the guard 40 is moved upward.

The front shelf lifting device may include a connection bar 20 configured to connect the front shelf 30 and the rear shelf 10 to each other and an interlocking mechanism configured to rotate the connection bar 20 and the guard 40 in opposite directions. The front shelf 30 is connected to the rear shelf 10 via the connection bar 20. When the guard 40 is moved upward, the front shelf 30 is moved downward. When the front shelf 30 is moved downward, the guard 40 is moved upward.

The interlocking mechanism may include a plurality of gears 50 and 60 configured to rotate the connection bar 20 and the guard 40 relative to each other. The gears 50 and 60 are configured such that the connection bar 20 and the guard 40 are rotated in opposite directions.

The inner case 2 defines a storage compartment C, such as a freezing compartment or a refrigerating compartment, therein. When a door, which is configured to open and close the storage compartment C, is opened, the interior of the storage compartment C may be exposed to the outside. The inner case 2 includes a side plate 3, which constitutes a left side plate or a right side plate, and a rear plate 4, which is perpendicular to the side plate 3.

The inner case 2 is located in an outer case 5, which defines the external appearance of the refrigerator. A space defined between the inner case 2 and the outer case 5 may be filled with an insulating material 6.

A structure configured to guide the movement of the front shelf 30 is provided in the inner case 2. A guide protrusion member 32 protrudes from the front shelf 30. The guide protrusion member 32 is guided by the inner case 2. A plurality of guide protrusion members 32 may be provided at the front shelf 30. The guide protrusion members 32 may be arranged such that the guide protrusion members 32 are spaced apart from each other in forward and rearward directions of the front shelf 30.

The inner case 2 is provided with a protrusion member guide rail 8, which is configured to guide the sliding movement of the guide protrusion member 32. The protrusion member guide rail 8 corresponds to the guide protrusion member 32 in terms of the number thereof. That is, the number of protrusion member guide rails 8 may be equal to the number of guide protrusion members 32. In a case in which a pair of guide protrusion members 32 is provided, a pair of protrusion member guide rails 8 may also be provided.

The protrusion member guide rail 8 extends along the movement path of the front shelf 30. The protrusion member guide rail 8 is formed to have the same shape as the movement path of the front shelf 30. In a case in which the front shelf 30 is configured to be moved in an arc-shaped path by the connection bar 20, the protrusion member guide rail 8 has an arc-shaped portion. The protrusion member guide rail 8 may be formed on the inner case 2 so as to have a protruding shape, or may be formed in the inner case 2 so as to have a concave shape.

The protrusion member guide rail 8 is provided at the lower end thereof with an elastic member 9, on which the guide protrusion member 32 is located. When the guide protrusion member 32 is located on the elastic member 9, the elastic member 9 may reduce the amount of impact that is applied to the guide protrusion member 32, and may minimize shaking of the guide protrusion member 32 located thereon. The guide protrusion member 32 may be moved downward along the protrusion member guide rail 8, may be located on the elastic member 9, and may be supported by the elastic member 9. The elastic member 9 may function as a kind of cushion. The elastic member 9 may be made of an elastic material, such as silicone or rubber.

The rear shelf 10 is horizontally disposed in the inner case 2. The rear shelf 10 is disposed closer to the rear plate 4 of the inner case than the front of the storage compartment C.

In some implementations, the rear shelf 10 is fixedly disposed in the inner case. In some implementations, the rear shelf 10 may be movably disposed in the inner case. When the connection bar 20 is rotated, the rear shelf 10 functions as the center of rotation of the connection bar 20. The connection bar 20 may be rotated about the rear shelf 10 in a clockwise direction on in a counterclockwise direction.

The end 21 of the connection bar 20 facing the lateral surface of the front shelf 30 is hinged to the front shelf 30.

A first hinge shaft 23 may be provided at one selected from between the connection bar 20 and the front shelf 30, and a first hinge shaft support part 33, by which the first hinge shaft 23 is rotatably supported, may be formed in the other selected from between the connection bar 20 and the front shelf 30 so as to have a recessed or hole shape.

The connection bar 20 is configured such that the end 22 of the connection bar 20 facing the rear shelf 10 is connected to the rear shelf 10. The end 22 of the connection bar 20 facing the rear shelf 10 is hinged to the rear shelf 10.

A second hinge shaft 24 may be provided at one selected from between the connection bar 20 and the rear shelf 10, and a second hinge shaft support part 14, by which the second hinge shaft 24 is rotatably supported, may be formed in the other selected from between the connection bar 20 and the rear shelf 10 so as to have a recessed or hole shape.

The connection bar 20 connects the rear shelf 10 and the front shelf 30 to each other. The connection bar 20 may be rotated about the rear shelf 10. When the front shelf 30 is moved downward or upward, the connection bar 20 is rotated about the rear shelf 10. That is, the connection bar 20 may be rotated by the front shelf 30.

The connection bar 20 is connected to the guard 40 via a plurality of gears 50 and 60. When the guard 40 is moved downward or upward, the connection bar 20 is interlocked with the guard 40, whereby the connection bar 20 is rotated about the rear shelf 10. That is, the connection bar 20 may be rotated by the guard 40.

The connection bar 20 includes a pair of connection bars, which connect the rear shelf 10 and the front shelf 30 to each other. The left side of the rear shelf 10 and the left side of the front shelf 30 are connected to each other via a left connection bar 20A, and the right side of the rear shelf 10 and the right side of the front shelf 30 are connected to each other via a right connection bar 20B. The following description will be given based on the connection bar 20.

The interlocking mechanism includes a first gear 50, which is formed at the connection bar 20. The first gear 50 is formed at the end of the connection bar 20 that faces the lateral surface of the front shelf 30 such that the first gear 50 is opposite to a second gear 60. A pair of first gears 50 may be provided for each rear shelf 10. In some implementations, the first gear 50 includes a first left gear 50A formed at the left connection bar 20A and a first right gear 50B formed at the right connection bar 20B. The following description will be given based on the first gear 50.

The front shelf 30 is moved in a state in which the front shelf 30 is connected to the rear shelf 10 via the connection bar 20.

When the connection bar 20 is rotated, the front shelf 30 is moved upward or downward along an arc-shaped path corresponding to the rotation of the connection bar 20.

As shown in FIG. 1, the front shelf 30 may be moved upward to the front of the rear shelf 10 such that the front shelf 30 is located at the same height as the rear shelf 10. When the front shelf 30 is moved upward to the front of the rear shelf 10, the front shelf 30 is arranged in line with the rear shelf 10 in the forward and rearward directions. In some implementations, the rear shelf 10 and the front shelf 30 may function as a single shelf that extends in the forward and rearward directions.

Figure 3:
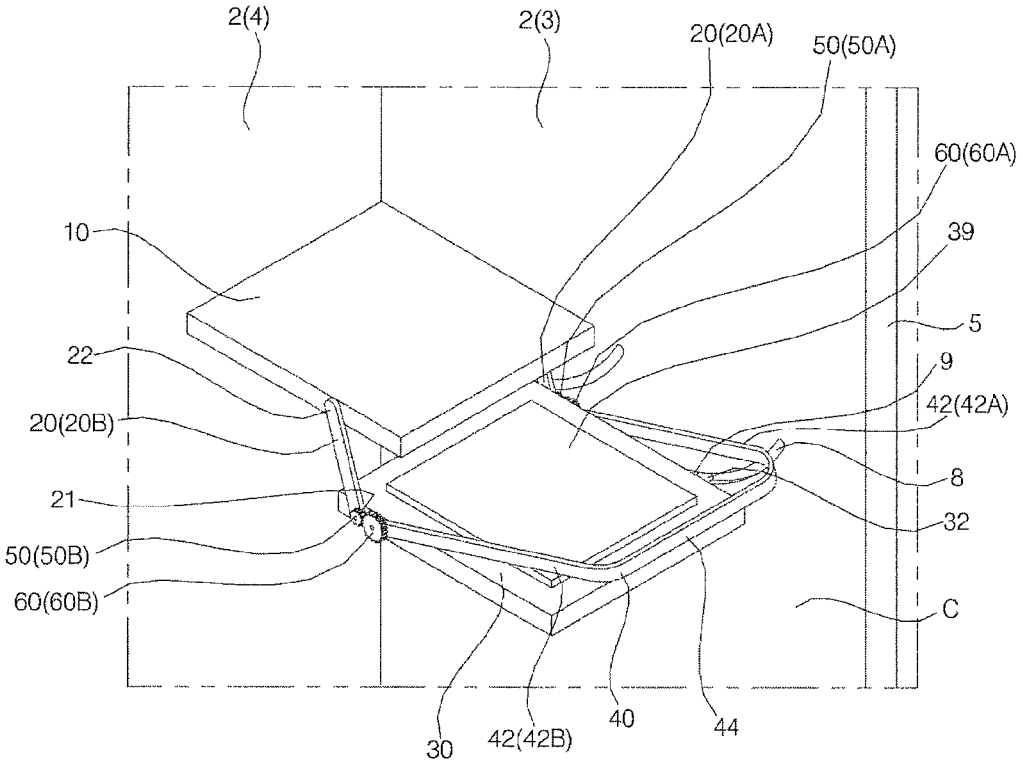
FIG. 3 is a perspective view of a front shelf shown in FIG. 2 that has been moved downward and a guard shown in FIG. 2 that has been moved upward.
Figure 4:
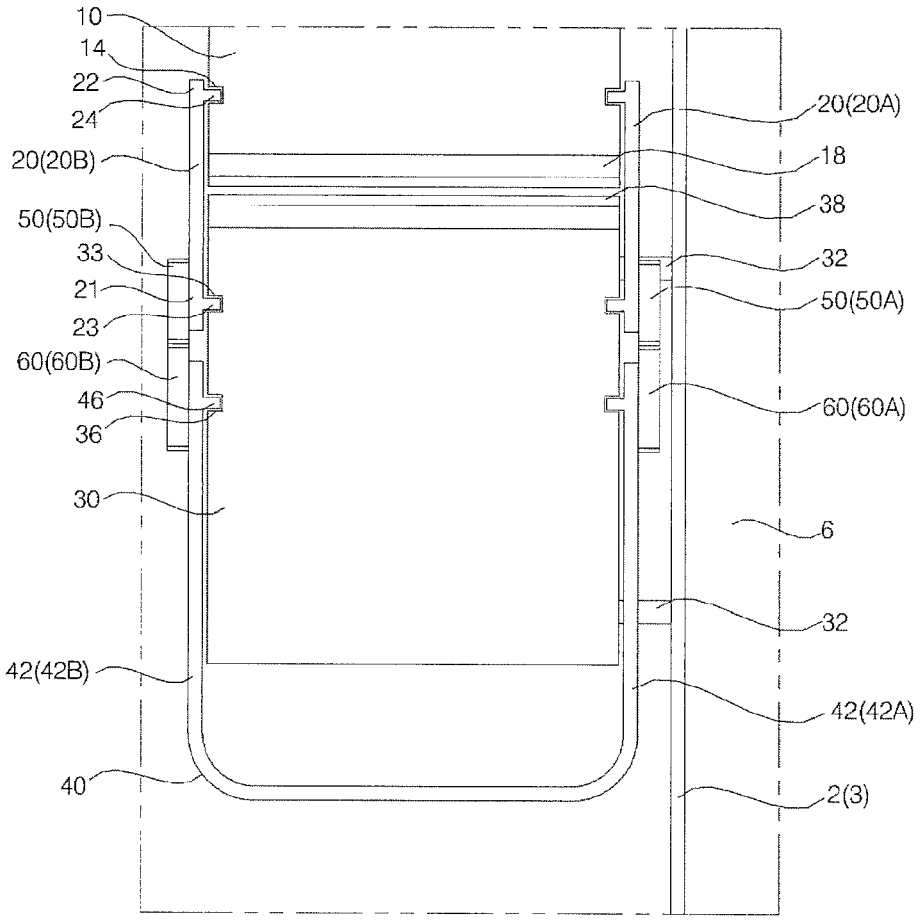
FIG. 4 is a cross sectional view of an example rear shelf and an example front shelf of a refrigerator.
Figure 5:
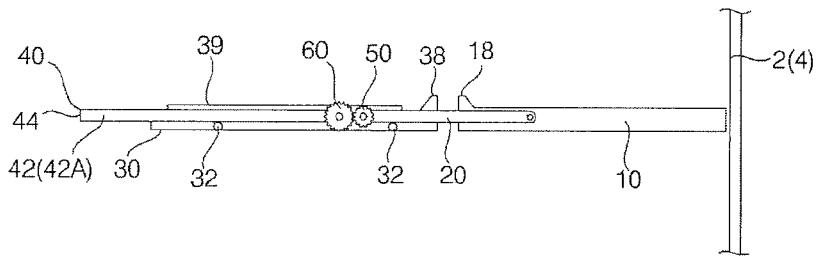
FIG. 5 is a side view of a rear shelf and a front shelf shown in FIG. 1.

As shown in FIG. 3, the front shelf 30 may be moved downward to the lower side of the front of the rear shelf 10 such that the front shelf 30 is located at a height different from the height of the rear shelf 10. When the front shelf 30 is moved downward to the lower side of the rear shelf 10, as shown in FIG. 3, the front shelf 30 constitutes a stepped shelf unit together with the rear shelf 10. In some implementations, the rear shelf 10 may be an upper shelf, and the front shelf 30 may be a lower shelf. The rear shelf 10 and the front shelf 30 may be moved so as to constitute a separate stepped shelf unit.

A non-slip mat 39, which prevents slippage of articles, such as food, (hereinafter, referred to as 'stored goods'), may be disposed on the front shelf 30. The non-slip mat 39 is a member that exhibits high frictional force. The upper surface of the non-slip mat 39 may be rugged. The non-slip mat 39 is attached to the upper surface of the front shelf 30.

The guard 40 is rotated about the front shelf 30. When the guard 40 is rotated, the front shelf 30 functions as the center of rotation of the guard 40.

The guard 40 includes a side guard 42 located at the side of the lateral surface 31 of the front shelf 30 and a front guard 44 located at the front of the front surface 32 of the front shelf 30.

The side guard 42 includes a left guard part 42A located at the side of the left lateral surface 31A of the front shelf 30 and a right guard part 42B located at the side of the right lateral surface 31B of the front shelf 30.

The front guard 44 is formed to connect the left guard part 42A and the right guard part 42B to each other.

The guard 40 is connected to the connection bar 20 via the gears 50 and 60. When the front shelf 30 has been moved upward, the guard 40 is located around the edge of the front shelf 30. When the front shelf 30 has been moved downward, a portion of the guard 40 is located around the upper side of the front shelf 30.

When the front shelf 30 is disposed at the front of the rear shelf 10 and in line with the rear shelf 10, as shown in FIG. 1, the guard 40 surrounds a portion of the lateral surface and the front surface of the front shelf 30.

Figure 2:
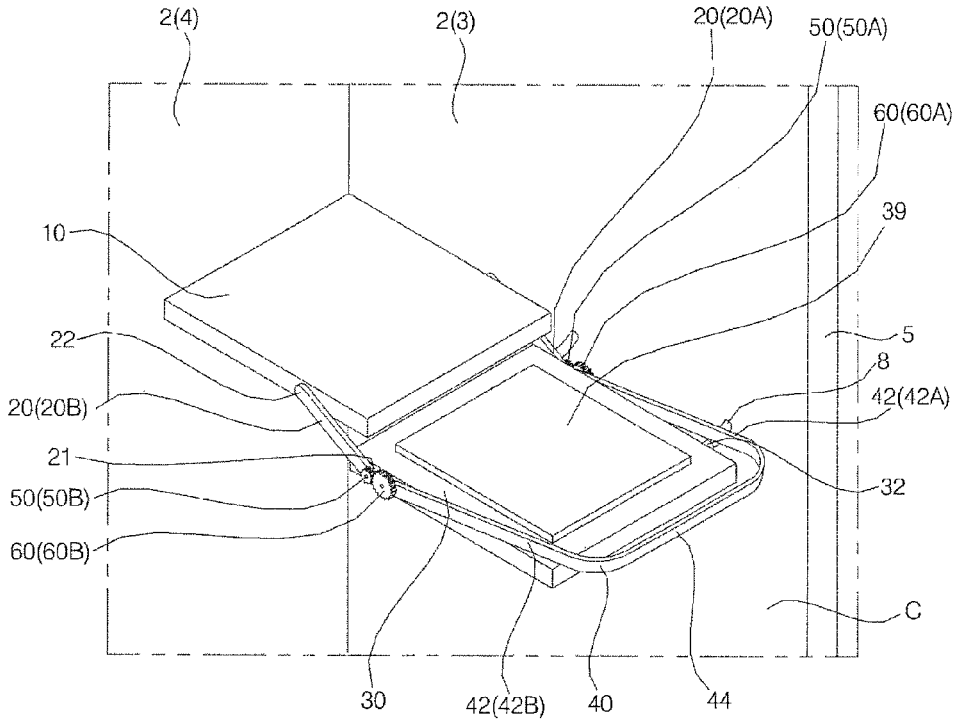
FIG. 2 is a perspective view of a front shelf shown in FIG. 1 that is being moved downward and a guard shown in FIG. 1 that is being moved upward.

As shown in FIGS. 2 and 3, the guard 40 may be rotated upward about the front shelf 30. At this time, the front shelf 30 is moved downward to the lower side of the front of the rear shelf 10, and the front guard 44 is located at the upper side of the front shelf 30 or around the upper side of the front shelf 30. The stored goods placed on the front shelf 30 are supported by the guard 40, thereby maximally preventing the stored goods on the front shelf 30 from tipping over on the front shelf 30 or falling off the front shelf 30.

The side guard 42 is hinged to the front shelf 30.

A third hinge shaft 46 may be provided at one selected from between the side guard 42 and the front shelf 30, and a third hinge shaft support part 36, by which the third hinge shaft 46 is rotatably supported, may be formed in the other selected from between the side guard 42 and the front shelf 30 so as to have a recessed or hole shape.

The side guard 42 is rotated upward at the side of the front shelf 30, and is rotated downward at the upper side of the front shelf 30.

The front guard 44 is moved together with the side guard 42. The front guard 44 may be moved upward from the front of the front surface of the front shelf 30 to the upper side of the upper surface of the front shelf 30. The front guard 44 may be moved downward from the upper side of the upper surface of the front shelf 30 to the front of the front surface of the front shelf 30.

The interlocking mechanism further includes a second gear 60 formed at the guard 40 such that the second gear 60 is engaged with the first gear 50 in order to rotate the guard 40 and the connection bar 20 in opposite directions.

The second gear 60 is formed at the side guard 42. The side guard 42 is configured such that a portion of the side guard 42 constantly faces the front shelf 30 irrespective of the rotation thereof.

A pair of second gears 60 may be provided for each guard 40. In some implementations, the second gear 60 includes a second left gear 60A formed at the left guard part 42A and a second right gear 60B formed at the right guard part 42B. The following description will be given based on the second gear 60.

The second gear 60 may have a diameter greater than the diameter of the first gear 50. In a case in which the second gear 60 has a diameter greater than the diameter of the first gear 50, the rotation angle of the guard 40 is less than the rotation angle of the connection bar 20. On the other hand, in a case in which the second gear 60 has a diameter less than the diameter of the first gear 50, the rotation angle of the guard 40 is greater than the rotation angle of the connection bar 20.

In a case in which the height difference between the rear shelf 10 and the front shelf 30 is small, and the guard 40 is located too high, it is inconvenient to place goods to be stored on the front shelf 30 and the rear shelf 10 and to remove the stored goods from the front shelf 30 and the rear shelf 10. On the other hand, in a case in which the height difference between the rear shelf 10 and the front shelf 30 is great, and the guard 40 is not located too high, it is convenient to place goods to be stored on the front shelf 30 and the rear shelf 10 and to remove the stored goods from the front shelf 30 and the rear shelf 10. For this reason, it is required that the diameter of the second gear 60 be greater than the diameter of the first gear 50.

The refrigerator may further include protruding parts 18 and 38 formed on at least one selected from the upper part of the front end of the rear shelf 10 and the upper part of the rear end of the front shelf 30 such that the protruding parts 18 and 38 protrude upward. In a state in which the front shelf 30 is disposed at the front of the rear shelf 10 and in line with the rear shelf 10 in a horizontal direction, the stored goods may be placed at the border between the rear shelf 10 and the front shelf 30. In some implementations, the stored goods placed at the border between the rear shelf 10 and the front shelf 30 may tip over during the downward movement of the front shelf 30. The protruding parts 18 and 38 prevent the stored goods from being placed at the border between the rear shelf 10 and the front shelf 30.

In some implementations, a rear protruding part 18 may be formed at the upper part of the front end of the rear shelf 10, but no protruding part may be formed at the upper part of the rear end of the front shelf 30. In addition, no protruding part may be formed at the upper part of the front end of the rear shelf 10, and a front protruding part 38 may be formed at the upper part of the rear end of the front shelf 30. In addition, the rear protruding part 18 may be formed at the upper part of the front end of the rear shelf 10, and the front protruding part 38 may be formed at the upper part of the rear end of the front shelf 30.

The protruding parts 18 and 38 may be configured such that, when the front shelf 30 is located at the lower side of the front of the rear shelf 10, the protruding parts 18 and 38 protrude lower than the height H1 of the guard 40.

Hereinafter, the operation of an example refrigerator will be described in detail.

Figure 6:
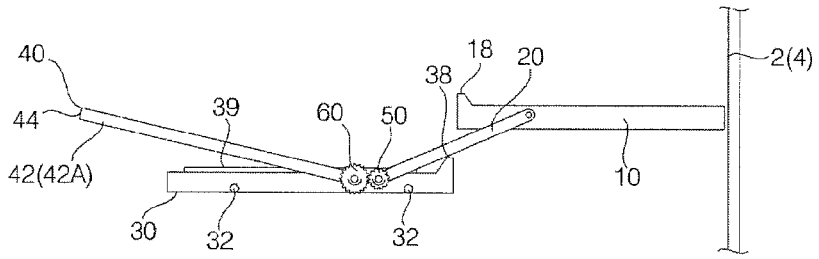
FIG. 6 is a side view of a rear shelf and a front shelf shown in FIG. 2.
Figure 7:
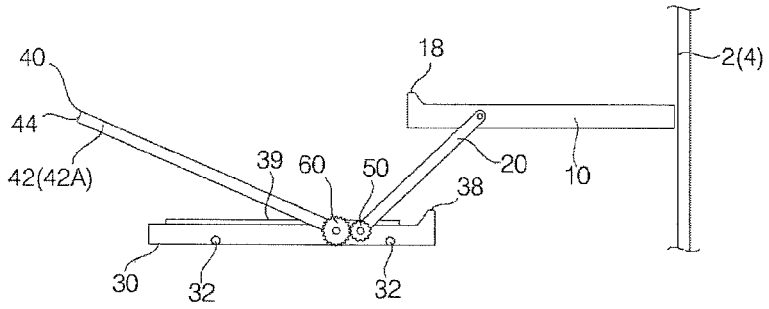
FIG. 7 is a side view of a rear shelf and a front shelf shown in FIG. 3.

First, a user may lift the guard 40 upward while holding the guard 40. The user may lift one selected from between the side guard 42 and the front guard 44 of the guard 40. At this time, as shown in FIG. 6, the second gear 60 rotates the first gear 50 in a direction opposite to a direction in which the second gear 60 is rotated. When the guard 40 is lifted upward, the second gear is rotated in the counterclockwise direction, and the first gear 50 is rotated in the clockwise direction in which the first gear 50 is engaged with the second gear 60.

When the first gear 50 is rotated in the clockwise direction, the connection bar 20 is rotated about the rear shelf 10 in the clockwise direction. When the connection bar 20 is rotated in the clockwise direction, the front shelf 30, which is connected to the connection bar 20, is moved about the rear shelf 10 according to the rotation of the connection bar 20.

The rear shelf 10 is moved from the front of the front shelf 30 to the lower side of the front of the front shelf 30. At this time, a portion of the guard 40 is located at the upper side of the front shelf 30, which is being moved, or around the upper side of the front shelf 30.

During the upward movement of the guard 40 and the movement of the front shelf 30 as described above, the guard 40 may prevent the stored goods placed on the front shelf 30 from tipping over on the front shelf 30 or falling off the front shelf 30.

The front shelf 30 is located at the lower side of the front of the rear shelf 10 such that the front shelf 30 has a height different from the height of the rear shelf 10. Consequently, the rear shelf 10 and the front shelf 30 may be moved so as to constitute a separate stepped shelf unit.

The user may remove the stored goods from the front shelf 30, which is located lower than rear shelf 10, or may place goods to be stored on the front shelf 30 via the guard 40. In addition, the user may remove the stored goods from the rear shelf 10 via the front shelf 30, which is located lower than rear shelf 10, and the guard 40, or may place goods to be stored on the rear shelf 10 via the front shelf 30, which is located lower than rear shelf 10, and the guard 40.

The user may lower the guard 40 downward while holding the guard 40, or may lift the front shelf 30 upward while holding the front shelf 30. In some implementations, the connection bar 20 and the guard 40 are rotated in directions opposite to the directions of rotation when the guard 40 is moved upward, and the front shelf 30 is located at the front of the rear shelf 10 and in line with the rear shelf 10. The guard 40 is located at the same height as the front shelf 30, with the result that the guard 40 surrounds a portion of the edge of the front shelf 30.

FIGS. 8-12 illustrate example front shelves and example guards of a refrigerator. FIG. 13 illustrates an example protrusion member guide rail.

Figure 9:
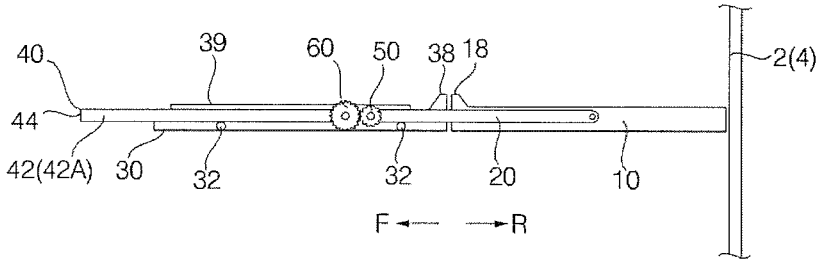
FIG. 9 is a side view of an example rear shelf and an example front shelf of a refrigerator.
Figure 10:
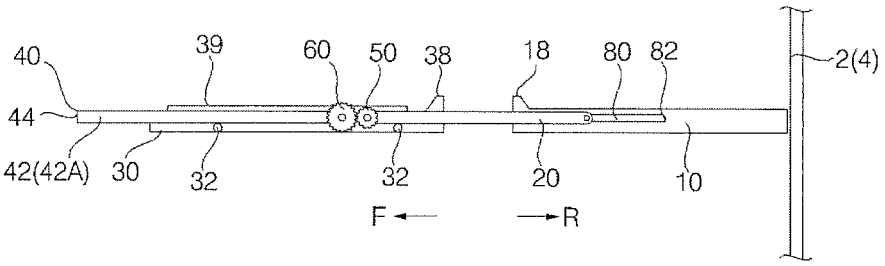
FIG. 10 is a side view of a front shelf shown in FIG. 9 that has been moved forward.

In some implementations, a connection bar guide rail 80, which is configured to guide the sliding movement of a connection bar 20, is formed at a rear shelf 10. The sliding movement of the connection bar 20 in forward and rearward directions is guided by the connection bar guide rail 80. As shown in FIG. 9, the connection bar 20 may be slid along the connection bar guide rail 80 in a rearward direction R. In addition, as shown in FIG. 10, the connection bar 20 may be slid along the connection bar guide rail 80 in a forward direction F.

In some implementations, the connection bar 20 is connected to a front shelf 30 via a first hinge shaft 23.

The sliding movement of a second hinge shaft 24 of the connection bar 20 in the forward and rearward directions is guided along the connection bar guide rail 80. When the sliding movement of the second hinge shaft 24 is guided along the connection bar guide rail 80, the front shelf 30 is slid together with the connection bar 20 in a state in which the front shelf 30 is connected to the connection bar 20 via the first hinge shaft 23.

Figure 8:
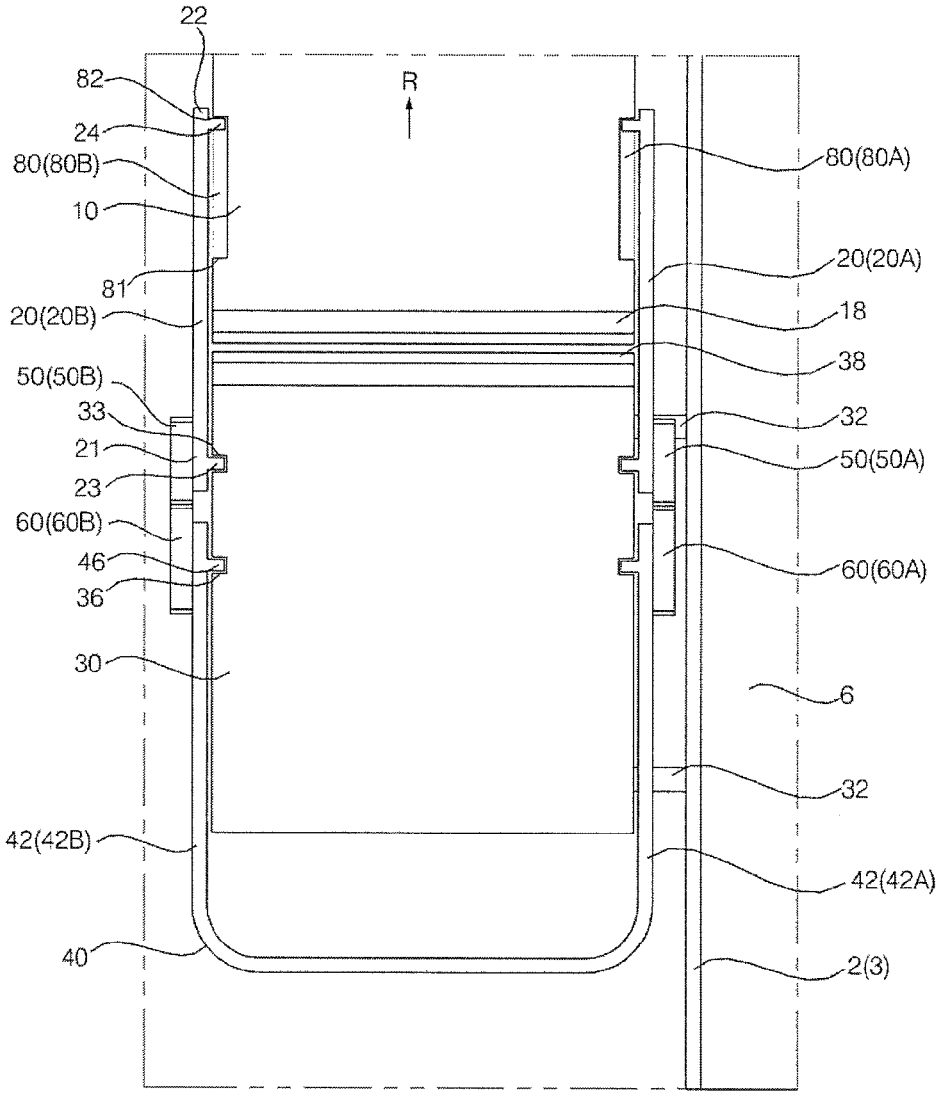
FIG. 8 is a cross sectional view of an example rear shelf and an example front shelf of a refrigerator.

As shown in FIG. 8, the connection bar guide rail 80 is configured such that the front and rear ends of the connection bar guide rail 80 are closed. The connection bar guide rail 80 includes a front end stopper 81, by which the second hinge shaft 24 is caught in the forward direction, and a rear end stopper 82, by which the second hinge shaft 24 is caught in the rearward direction. The connection bar guide rail 80 is formed on at least one selected from between the left side and the right side of the rear shelf 10.

In a case in which the connection bar 20 includes a left connection bar 20A and a right connection bar 20B, the connection bar guide rail 80 includes a left connection bar guide rail 80A, which is formed at the left side of the rear shelf 10 to guide the sliding movement of the left connection bar 20A, and a right connection bar guide rail 80B, which is formed at the right side of the rear shelf 10 to guide the sliding movement of the right connection bar 20B. The following description will be given based on the connection bar guide rail 80.

The second hinge shaft 24 may be a protrusion member that is guided along the connection bar guide rail 80. The second hinge shaft 24 may be formed to have a cylindrical shape.

When the second hinge shaft 24 reaches the front end stopper 81, the second hinge shaft 24 is caught by the front end stopper 81, with the result that the second hinge shaft 24 does not move any further. When the second hinge shaft 24 reaches the front end stopper 81, the connection bar 20 may be rotated about the second hinge shaft 24.

The second hinge shaft 24 may be slid between a position at which the second hinge shaft 24 reaches the rear end stopper 82 and a position at which the second hinge shaft 24 reaches the front end stopper 81.

When the connection bar 20 is rotated about a portion of the connection bar guide rail 80, the front shelf 30 is rotated about one side of the connection bar guide rail 80 together with the connection bar 20.

In some implementations, a guide protrusion member 32 is formed at the front shelf 30. A protrusion member guide rail 8' configured to guide the guide protrusion member 32 is provided in an inner case 2, which defines a storage compartment therein. When the second hinge shaft 24 is moved along the connection bar guide rail 80 in the forward and rearward directions, the protrusion member guide rail 8' guides the movement of the guide protrusion member 32, which is formed at the front shelf 30. The protrusion member guide rail 8' includes a straight guide rail 8A configured to guide the guide protrusion member 32 in a straight line.

The protrusion member guide rail 8' may further include at least one curved guide rail 8B (8C) configured to guide the guide protrusion member 32 when the second hinge shaft 24 is rotated in the connection bar guide rail 80.

The protrusion member guide rail 8' may include a front curved guide rail 8B configured to guide the guide protrusion member 32 when the second hinge shaft 24 is rotated in the front end stopper 81 of the connection bar guide rail 80. The front curved guide rail 8B is connected to the front of the straight guide rail 8A. The front curved guide rail 8B is formed to have an arc shape. In some implementations, an elastic member 9 may be provided at the lower end of the front curved guide rail 8B. When the front shelf 30 is rotated about the rear shelf 10 in a state in which the front shelf 30 has been moved in the forward direction F, as shown in FIG. 10, the front curved guide rail 8B guides the guide protrusion member 32 along an arc-shaped path.

The protrusion member guide rail 8' may include a rear curved guide rail 8C configured to guide the guide protrusion member 32 when the second hinge shaft 24 is rotated in the rear end stopper 82 of the connection bar guide rail 80. The rear curved guide rail 8C is connected to the rear of the straight guide rail 8A. The rear curved guide rail 8C is formed to have an arc shape. The rear curved guide rail 8C may be provided at the rear of the front curved guide rail 8B and in line with the front curved guide rail 8B. In some implementations, an elastic member 9 may be provided at the lower end of the rear curved guide rail 8C. When the front shelf 30 is rotated about the rear shelf 10 in a state in which the front shelf 30 has been moved in the rearward direction R, as shown in FIG. 9, the rear curved guide rail 8C guides the guide protrusion member 32 along an arc-shaped path.

Hereinafter, the operation of an example refrigerator will be described in detail.

A user may pull at least one selected from between the guard 40 and the front shelf 30 in the forward direction F while holding at least one selected from between the guard 40 and the front shelf 30. As shown in FIG. 10, the front shelf 30 is pulled together with the guard 40 in the forward direction F, and the connection bar 20 is pulled together with the front shelf 30 in the forward direction F as the sliding movement of the second hinge shaft 24 is guided along the connection bar guide rail 80 in the forward direction.

When the front shelf 30 is moved forward as described above, the front shelf 30 becomes more distant from the rear shelf 10, and is moved to the front of the rear shelf 10 in the forward direction F. As a result, the rear shelf 10 and the front shelf 30 are spaced apart from each other in the forward and rearward directions. When the front shelf 30 is moved forward, the guide protrusion member 32, which is formed at the front shelf 30, is guided along the straight guide rail 8A of the protrusion member guide rail 8', which is shown in FIG. 13, in the forward direction F in a straight line. The front shelf 30 is stably moved forward in a state in which the front shelf 30 is connected to the rear shelf 10 via the connection bar 20.

When the second hinge shaft 24 reaches the front end stopper 81 of the connection bar guide rail 80, the second hinge shaft 24 is caught by the front end stopper 81, with the result that the front shelf 30 does not move any further. That is, the forward movement of the front shelf 30 is completed.

Figure 11:
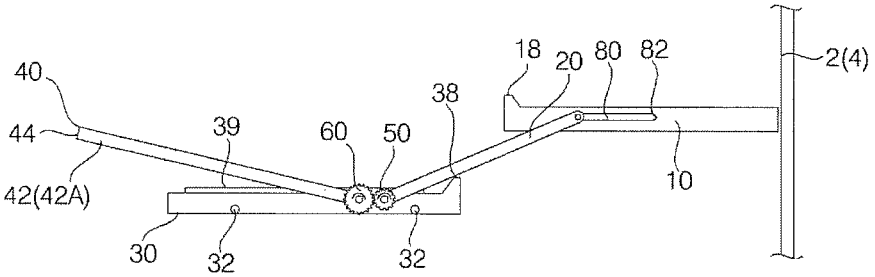
FIG. 11 is a side view of a front shelf shown in FIG. 10 that is being moved downward and a guard shown in FIG. 10 that is being moved upward.

Subsequently, in some implementations, the user may lift at least one selected from between the side guard 42 and the front guard 44 of the guard 40 upward. At this time, as shown in FIG. 11, the second gear 60 rotates the first gear 50 in a direction opposite to a direction in which the second gear 60 is rotated. When the first gear 50 is rotated, the second hinge shaft 24 of the connection bar 20 is rotated in the front end stopper 81 of the connection bar guide rail 80

When the first gear 50 is rotated, the connection bar 20 is rotated about the rear shelf 10. As shown in FIG. 11, the front shelf 30, which is connected to the rear shelf 10 via the connection bar 20, is moved about the rear shelf 10 according to the rotation of the connection bar 20, and a portion of the guard 40 is located at the upper side of the front shelf 30, which is being rotated, or around the upper side of the front shelf 30. When the front shelf 30 is moved as described above, the guide protrusion member 32, which is formed at the front shelf 30, the guide protrusion member 32, which is formed at the front shelf 30, is guided in an arc-shaped path along the front curved guide rail 8B of the protrusion member guide rail 8', which is shown in FIG. 13. The front shelf 30 is stably moved to the lower side of the front of the rear shelf 10.

During the upward movement of the guard 40 and the movement of the front shelf 30 as described above, the guard 40 may prevent the stored goods placed on the front shelf 30 from tipping over on the front shelf 30 or falling off the front shelf 30.

Figure 12:
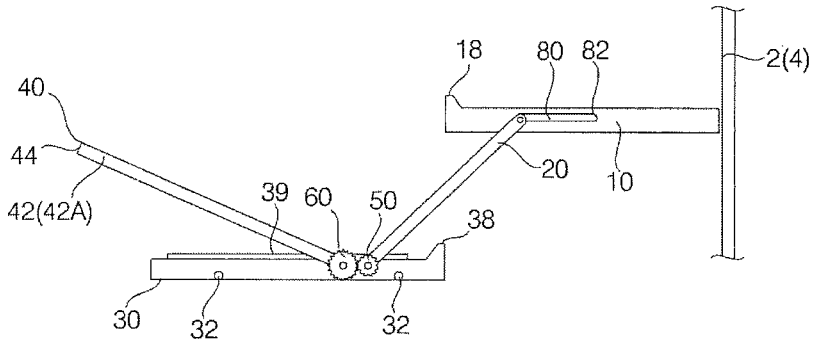
FIG. 12 is a side view of a front shelf shown in FIG. 11 that has been moved downward and a guard shown in FIG. 11 that has been moved upward.
Figure 13:
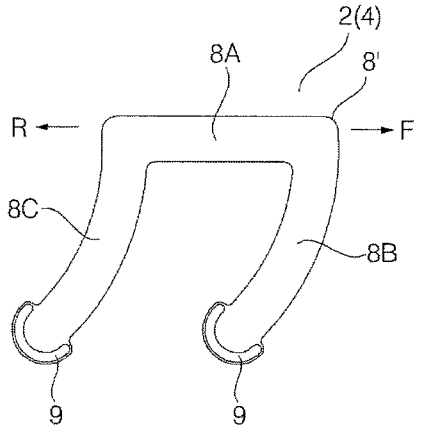
FIG. 13 is a side view of an example protrusion member guide rail that is located in an inner case that defines a storage compartment of the refrigerator.

In some implementations, the front shelf 30 is moved in the forward direction F, as shown in FIG. 10, and is rotated about the rear shelf 10, as shown in FIGS. 11 and 12. In some implementations, the front shelf 30 may be moved further in the forward direction than other implementations. Since the front shelf 30 has been pulled further in the forward direction F, it is possible for the user to more conveniently place goods to be stored on the front shelf 30 and to more conveniently remove the stored goods from the front shelf 30.

After the user puts goods to be stored on the front shelf 30 and the rear shelf 10 or removes the stored goods from the front shelf 30 and the rear shelf 10, the user may lower the guard 40 downward while holding the guard 40, or may lift the front shelf 30 upward while holding the front shelf 30. In some implementations, the connection bar 20 and the guard 40 are rotated in opposite directions, and the front shelf 30 is located at the front of the rear shelf 10 in a state in which the front shelf 30 is spaced apart from the rear shelf 10, as shown in FIG. 10. At this time, the guard 40 is located at the same height as the front shelf 30, with the result that the guard 40 surrounds a portion of the edge of the front shelf 30.

Subsequently, the user may push the guard 40 or the front shelf 30 in the rearward direction R. The front shelf 30 is moved in the rearward direction R together with the guard 40, and the connection bar 20 is pushed in the rearward direction R together with the front shelf 30. The sliding movement of the second hinge shaft 24 is guided along the connection bar guide rail 80 in the rearward direction R. The connection bar 20 is moved rearward toward the rear shelf 10, and the front shelf 30 approaches the rear shelf 10.

When the front shelf 30 is moved rearward as described above, the guide protrusion member 32, which is formed at the front shelf 30, is guided along the straight guide rail 8A of the protrusion member guide rail 8' in the rearward direction in a straight line, and the front shelf 30 stably approaches the rear shelf 10.

When the second hinge shaft 24 reaches the rear end stopper 82 of the connection bar guide rail 80, the second hinge shaft 24 is caught by the rear end stopper 82, with the result that the second hinge shaft 24 does not move any further. That is, the rearward movement of the front shelf 30 is completed.

When the front shelf 30 is removed in the rearward direction R, as shown in FIG. 9, the front shelf 30 approaches the front of the rear shelf 10, and is located in line with the rear shelf 10.

FIGS. 14-18 illustrate example front shelves and example guards of a refrigerator. FIG. 19 illustrates an example protrusion member guide rail.

In some implementations, a rear shelf guide 90, which is configured to guide the sliding movement of a rear shelf 10 in forward and rearward directions, is disposed in an inner case 2, which defines a storage compartment therein.

Figure 14:
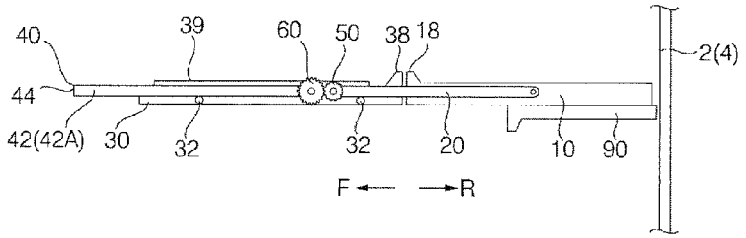
FIG. 14 is a side view of an example rear shelf and an example front shelf of a refrigerator.
Figure 15:
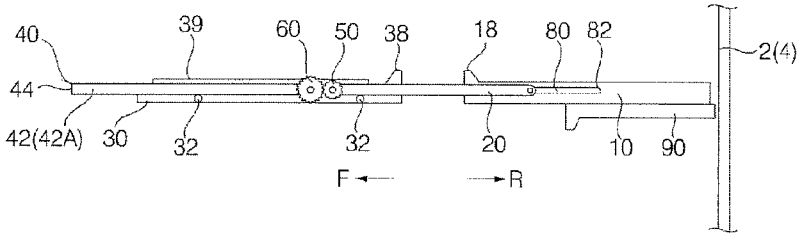
FIG. 15 is a side view of a front shelf shown in FIG. 14 that has been moved forward.
Figure 16:
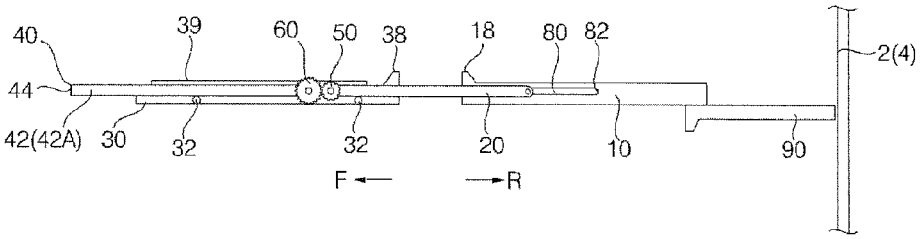
FIG. 16 is a side view of a front shelf and a rear shelf shown in FIG. 15 that have been moved forward.

The sliding movement of the rear shelf 10 in the forward and rearward directions is guided by the rear shelf guide 90. As shown in FIGS. 14 and 15, the rear shelf 10 may be slid along the rear shelf guide 90 in a rearward direction R. As shown in FIG. 16, the rear shelf 10 may be slid along the rear shelf guide 90 in a forward direction F.

The rear shelf guide 90 may be disposed in the inner case 2 such that the rear shelf guide 90 extends in the forward and rearward directions. The rear shelf guide 90 may guide the sliding movement of the rear shelf 10. The rear shelf 10 may be guided by the rear shelf guide 90 such that the rear shelf 10 can be moved in the forward and rearward directions.

The rear shelf guide 90 is located at the side of a side plate 3 of the inner case 2. The rear shelf guide 90 is disposed at the front of a rear plate 4 of the inner case 2.

The rear shelf guide 90 may be manufactured separately from the inner case 2, and may then be coupled to the inner case 2 using fastening members, such as screws or hooks. Alternatively, the rear shelf guide 90 may be integrally formed at the inner case 2. The rear shelf guide 90 may be formed in the inner case 2 such that the rear shelf guide 90 is concave, or may be formed on the inner case 2 such that the rear shelf guide 90 protrudes toward a storage compartment C.

The rear shelf guide 90 may include a front end stopper configured to limit the forward movement of the rear shelf 10. When the rear shelf 10 is maximally moved forward, the rear shelf 10 is caught by the front end stopper.

The rear shelf guide 90 may include a rear end stopper configured to limit the rearward movement of the rear shelf 10. When the rear shelf 10 is maximally moved rearward, the rear shelf 10 is caught by the rear end stopper. No rear end stopper may be formed at the rear shelf guide 90. In some implementations, the rear shelf 10 is configured such that, when the rear shelf 10 is maximally moved rearward, the rear shelf 10 comes into contact with the rear plate 4 of the inner case 2.

In some implementations, the refrigerator may further include a connection bar guide rail 80. In some implementations, the front shelf 30 may be slid in the forward and rearward directions through two stages. When the rear shelf 10 and the front shelf 30 have been moved in the rearward direction R, as shown in FIG. 14, the front shelf 30 is located at the rearmost possible position.

When the rear shelf 10 and the front shelf 30 have been moved in the forward direction F, as shown in FIG. 16, the front shelf 30 is located as far forward as possible.

When the rear shelf 10 has been moved in the rearward direction R and the front shelf 30 has been moved in the forward direction F, as shown in FIG. 15, the front shelf 30 is located between the forefront position and the rearmost position.

In a state in which the rear shelf 10 has been maximally moved rearward, the front shelf 30 may be moved toward the front of the rear shelf 10 in the forward direction F in a first stage. Subsequently, the rear shelf 10 is moved forward, and the front shelf 30 may be moved together with a connection bar 20 in a second stage.

In some implementations, the connection bar 20 may be hinged to the rear shelf 10, no connection bar guide rail 80 may be formed at the rear shelf 10, and the rear shelf 10 may be disposed at the rear shelf guide 90 such that the rear shelf 10 can be moved in the forward and rearward directions.

In some implementations, the front shelf 30 may be moved forward together with the rear shelf 10 in the first stage, and may be moved about the rear shelf 10, which has been moved along the rear shelf guide 90 in the forward direction F.

The following description will be given based on an example in which the rear shelf guide 90 is disposed in the inner case 2, and the connection bar guide rail 80 is formed at the rear shelf 10, such that the front shelf 30 can be moved forward through two stages.

In some implementations, a guide protrusion member 32 is formed at the front shelf 30. A protrusion member guide rail 8" configured to guide the guide protrusion member 32 is provided in the inner case 2.

The protrusion member guide rail 8" includes a straight guide rail 8D configured to guide the guide protrusion member 32 in a straight line. When the rear shelf 10 is moved along the rear shelf guide 90 in the forward and rearward directions, the straight guide rail 8D guides the guide protrusion member 32, which is formed at the front shelf 30. When a second hinge shaft 24 is moved along the connection bar guide rail 80 in the forward and rearward directions, the straight guide rail 8D guides the guide protrusion member 32, which is formed at the front shelf 30.

The protrusion member guide rail 8" may further include at least one curved guide rail 8E (8F and 8G) configured to guide the guide protrusion member 32 when the second hinge shaft 24 is rotated in the connection bar guide rail 80.

The straight guide rail 8D is sufficiently wide to guide the movement of the front shelf 20 in the forward and rearward directions through two stages. The straight guide rail 8D may have a length greater than the length of each of the curved guide rails 8E, 8F, and 8G.

The protrusion member guide rail 8" may include a front curved guide rail 8E configured to guide the guide protrusion member 32.

As shown in FIG. 19, the front curved guide rail 8E is connected to the front of the straight guide rail 8D. The front curved guide rail 8E is formed to have an arc shape. In some implementations, an elastic member 9 may be provided at the lower end of the front curved guide rail 8E. When the front shelf 30 is rotated about the rear shelf 10 in a state in which the front shelf 30 has been moved to the forefront position, as shown in FIG. 16, the front curved guide rail 8E guides the guide protrusion member 32 along an arc-shaped path. The front curved guide rail 8E may be shorter than the straight guide rail 8D.

When the second hinge shaft 24 is rotated in a state in which the rear shelf 10 has been maximally moved forward along the rear shelf guide 90 and the connection bar 20 has been maximally moved forward along the connection bar guide rail 80, as shown in FIG. 16, the front curved guide rail 8E guides the movement of the guide protrusion member 32.

The protrusion member guide rail 8" may further include a center curved guide rail 8F configured to guide the guide protrusion member 32.

As shown in FIG. 19, the center curved guide rail 8F is connected to the middle of the straight guide rail 8D. The center curved guide rail 8F is formed to have an arc shape. In some implementations, an elastic member 9 may be provided at the lower end of the center curved guide rail 8F. When the front shelf 30 is rotated about the rear shelf 10 in a state in which the front shelf 30 has been moved to the middle position, the center curved guide rail 8F guides the guide protrusion member 32 along an arc-shaped path.

When the second hinge shaft 24 is rotated in a state in which the rear shelf 10 has been maximally moved rearward and the connection bar 20 has been maximally moved forward along the connection bar guide rail 80, as shown in FIG. 15, the center curved guide rail 8F guides the movement of the guide protrusion member 32.

The protrusion member guide rail 8" may further include a rear curved guide rail 8G configured to guide the guide protrusion member 32.

As shown in FIG. 19, the rear curved guide rail 8G is connected to the rear of the straight guide rail 8D. The rear curved guide rail 8G is formed to have an arc shape. In some implementations, an elastic member 9 may be provided at the lower end of the rear curved guide rail 8G. When the front shelf 30 is rotated about the rear shelf 10 in a state in which the front shelf 30 has been moved to the rearmost position, the rear curved guide rail 8G guides the guide protrusion member 32 along an arc-shaped path.

When the second hinge shaft 24 is rotated in a state in which the rear shelf 10 has been maximally moved rearward and the connection bar 20 has been maximally moved rearward along the connection bar guide rail 80, as shown in FIG. 14, the rear curved guide rail 8G guides the movement of the guide protrusion member 32.

Hereinafter, the operation of an example refrigerator will be described in detail.

First, a user may pull at least one selected from between the guard 40 and the front shelf 30 in the forward direction F while holding at least one selected from between the guard 40 and the front shelf 30. As shown in FIG. 15, the front shelf 30 is pulled together with the guard 40 in the forward direction F, and the connection bar 20 is pulled together with the front shelf 30 in the forward direction F as the sliding movement of the second hinge shaft 24 is guided along the connection bar guide rail 80 in the forward direction.

When the front shelf 30 is moved forward as described above, the front shelf 30 becomes more distant from the rear shelf 10, and is moved to the front of the rear shelf 10 in the forward direction F. As a result, the rear shelf 10 and the front shelf 30 are spaced apart from each other in the forward and rearward directions.

During the forward movement of the front shelf 30, the second hinge shaft 24 reaches the front end stopper 81 of the connection bar guide rail 80, and is caught by the front end stopper 81 of the connection bar guide rail 80. At this time, the front shelf 30 is moved forward in a first stage in a state in which the front shelf 30 is spaced apart from the rear shelf 10.

When the user continuously pulls the front shelf 30 in the forward direction F, the rear shelf 10 is moved in the forward direction F by the connection bar 20, and the rear shelf guide 90 guides the forward movement of the rear shelf 10. When the rear shelf 10 is moved forward by the connection bar 20, as shown in FIG. 16, the front shelf 30 is moved forward in a second stage in a state in which the front shelf 30 is spaced apart from the rear shelf 10.

Figure 17:
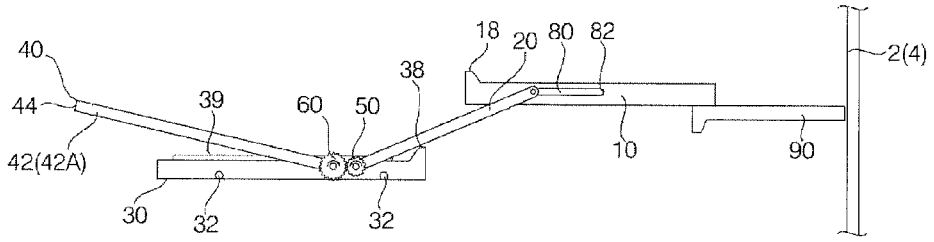
FIG. 17 is a side view of a front shelf shown in FIG. 16 that is being moved downward and a guard shown in FIG. 16 that is being moved upward.

Subsequently, in some implementations, the user may lift at least one selected from the side guard 42 and the front guard 44 of the guard 40 upward. At this time, as shown in FIG. 17, the second gear 60 rotates the first gear 50 in a direction opposite to a direction in which the second gear 60 is rotated. During the rotation of the first gear 50, the second hinge shaft 24 of the connection bar 20 is rotated in a state in which the second hinge shaft 24 is located in the front end stopper 81 of the connection bar guide rail 80.

During the rotation of the first gear 50, the connection bar 20 is rotated about the rear shelf 10, which has been moved forward, and the front shelf 30, which is connected to the rear shelf 10 via the connection bar 20, is moved along the connection bar 20 about the rear shelf 10, which has been moved forward. A portion of the guard 40 is located at the upper side of the front shelf 30, which is being moved, or around the upper side of the front shelf 30.

During the movement of the front shelf 30 after the forward movement of the front shelf 30 through the two stages as described above, the guard 40 may prevent the stored goods placed on the front shelf 30 from tipping over on the front shelf 30 or slipping toward the perimeter of the front shelf 30.

Figure 18:
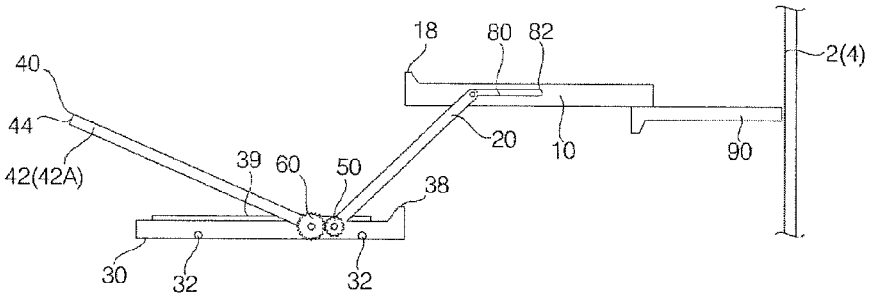
FIG. 18 is a side view of a front shelf shown in FIG. 17 that has been moved downward and a guard shown in FIG. 17 that has been moved upward.
Figure 19:
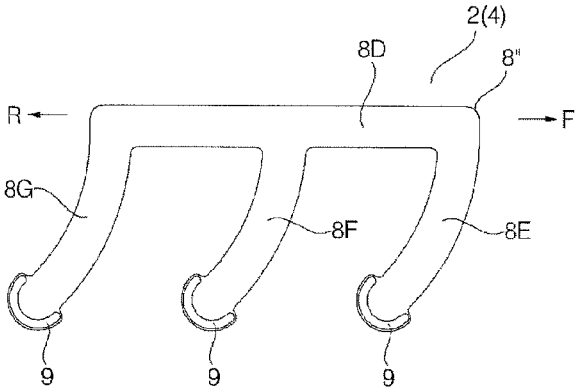
FIG. 19 is a side view of an example protrusion member guide rail that is located in an inner case that defines a storage compartment of the refrigerator.

In some implementations, the front shelf 30 is moved in the forward direction F through two stages, as shown in FIGS. 14 to 16, and is rotated about the rear shelf 10, which has been moved forward, as shown in FIGS. 17 and 18. In some implementations, the front shelf 30 may be moved further in the forward direction than other implementations. Since the front shelf 30 has been pulled further in the forward direction F, it is possible for the user to more conveniently place goods to be stored on the front shelf 30 and to more conveniently remove the stored goods from the front shelf 30. In addition, since the rear shelf 10 has also been moved in the forward direction F, it is possible for the user to more conveniently place goods to be stored on the rear shelf 10 and to more conveniently remove the stored goods from the rear shelf 10.

After the user places goods to be stored on the front shelf 30 and the rear shelf 10 or removes the stored goods from the front shelf 30 and the rear shelf 10, the user may lower the guard 40 downward while holding the guard 40, or may lift the front shelf 30 upward while holding the front shelf 30. In some implementations, the connection bar 20 and the guard 40 are rotated in opposite directions, and the front shelf 30 is located at the front of the rear shelf 10 in a state in which the front shelf 30 is spaced apart from the rear shelf 10, as shown in FIG. 16. At this time, the guard 40 is located at the same height as the front shelf 30, with the result that the guard 40 surrounds a portion of the edge of the front shelf 30.

Subsequently, the user may push the guard 40 or the front shelf 30 in the rearward direction R. The front shelf 30 is moved in the rearward direction R together with the guard 40, and the connection bar 20 is pushed in the rearward direction R together with the front shelf 30. The rear shelf 10 is moved in the rearward direction R by the connection bar 20.

As shown in FIG. 14, both the front shelf 30 and the rear shelf 10 are moved rearward, and the front shelf 30 is located in line with the rear shelf 10 in a state in which the front shelf 30 is adjacent to the front of the rear shelf 10.

What is claimed is:

1. A refrigerator comprising:
- a rear shelf that is located in a case that defines a storage compartment with an open front;
- a front shelf that is located closer to the open front of the storage compartment than the rear shelf;
- a guard that is rotatably connected to the front shelf; and
- a front shelf lifting device that is configured to rotate the front shelf down about an axis at the rear shelf and move the guard up and that comprises:
  - a connection bar that is configured to connect the front shelf and the rear shelf, that includes a first end that is rotatably connected to the front shelf, and that includes a second end that is rotatably connected to the rear shelf; and
  - an interlocking mechanism that is configured to rotate the connection bar in a first direction, that is configured to rotate the guard in a second direction that is opposite the first direction during rotation of the connection bar, and that comprises:
    - a first gear that is located at the connection bar; and
    - a second gear that is located at the guard and that is configured to rotate the guard in the second direction and the connection bar in the first direction by engaging the first gear,
    - wherein upward movement of the guard causes downward movement of the front shelf.

2. The refrigerator according to claim 1, wherein the front shelf lifting device is configured to maintain an orientation of the front shelf during rotation.

3. The refrigerator according to claim 1, wherein the interlocking mechanism is configured to:
- prevent rotation of the connection bar in the first direction while the guard rotates in the second direction, and
- prevent rotation of the guard in the second direction while the connection bar rotates in the first direction.

4. The refrigerator according to claim 1, wherein the guard comprises:
- a side guard that is located at a lateral surface of the front shelf; and
- a front guard that is located at a front surface of the front shelf.

5. The refrigerator according to claim 4, wherein the side guard comprises:
- a left guard part that is located at a left lateral surface of the front shelf; and
- a right guard part that is located at a right lateral surface of the front shelf.

6. The refrigerator according to claim 4, wherein the side guard is hinged to the front shelf.

7. The refrigerator according to claim 1, wherein the guard comprises:
- a side guard that is located at a lateral surface of the front shelf; and
- a front guard that is located at a front surface of the front shelf,
- wherein the second gear is located at the side guard.

8. The refrigerator according to claim 1, wherein an end of the connection bar that faces a lateral surface of the front shelf is hinged to the front shelf.

9. The refrigerator according to claim 1, wherein the first gear is located at an end of the connection bar that faces a lateral surface of the front shelf and is adjacent to the second gear.

10. The refrigerator according to claim 1, wherein a diameter of the second gear is greater than a diameter of the first gear.

11. The refrigerator according to claim 1, wherein:
- the front shelf includes a guide protrusion member that protrudes from the front shelf, and
- the case includes a protrusion member guide rail that is configured to guide a sliding movement of the guide protrusion member.

12. The refrigerator according to claim 11, further comprising an elastic member that is located at a lower end of the protrusion member guide rail and that is connected to the guide protrusion member.

13. The refrigerator according to claim 1, further comprising a protruding part that is located on at least one of an upper part of a front end of the rear shelf or an upper part of a rear end of the front shelf and that is configured to protrude upward.

14. The refrigerator according to claim 1, wherein the rear shelf includes a connection bar guide rail that is configured to guide a sliding movement of the connection bar towards a front of the refrigerator and towards a rear of the refrigerator.

15. The refrigerator according to claim 14, wherein the connection bar guide rail is configured to maintain the front shelf and the rear shelf in a same plane during the sliding movement of the connection bar towards the front of the refrigerator and towards the rear of the refrigerator.

16. The refrigerator according to claim 1, wherein a rear shelf guide is located in the case and is configured to guide a sliding movement of the rear shelf towards a front of the refrigerator and towards a rear of the refrigerator.

17. The refrigerator according to claim 1, further comprising a non-slip mat that is located on a top surface of the front shelf.

18. The refrigerator according to claim 1, wherein the front shelf lifting device is configured to move a rear portion of front shelf below a front portion of the rear shelf.

* * * * *